US011248447B2

(12) United States Patent
Munro et al.

(10) Patent No.: US 11,248,447 B2
(45) Date of Patent: Feb. 15, 2022

(54) MOVING TOOLS ON OFFSHORE STRUCTURES WITH A WALKING CARRIAGE

(71) Applicant: Subsea 7 Limited, Sutton (GB)

(72) Inventors: Stewart John Sinclair Munro, Westhill (GB); Michael John Fowkes, Banchory (GB); Ian Adamson, Aberdeen (GB)

(73) Assignee: Subsea 7 Limited, Sutton (GB)

( * ) Notice: Subject to any disclaimer, the term of this patent is extended or adjusted under 35 U.S.C. 154(b) by 0 days.

(21) Appl. No.: 15/934,914

(22) Filed: Mar. 23, 2018

(65) Prior Publication Data

US 2018/0208283 A1 Jul. 26, 2018

Related U.S. Application Data

(62) Division of application No. PCT/GB2016/052926, filed on Sep. 20, 2016.

(30) Foreign Application Priority Data

Sep. 25, 2015 (GB) ..... 1516998

(51) Int. Cl.
*E21B 41/00* (2006.01)
*E02B 17/00* (2006.01)
(Continued)

(52) U.S. Cl.
CPC ..... *E21B 41/0007* (2013.01); *B63C 11/52* (2013.01); *B63G 8/001* (2013.01); *E02B 17/0034* (2013.01); *B63G 2008/005* (2013.01)

(58) Field of Classification Search
CPC combination set(s) only.
See application file for complete search history.

(56) References Cited

U.S. PATENT DOCUMENTS 3,717,000 A 2/1973 Rothwell, Jr.
4,893,512 A * 1/1990 Tanimoto ..... F22B 37/006 73/622

(Continued)

FOREIGN PATENT DOCUMENTS

CN 204472948 7/2015
GB 2 202 887 10/1988

(Continued)

*Primary Examiner* — Kyle Armstrong
(74) *Attorney, Agent, or Firm* — Levy & Grandinetti

(57) ABSTRACT

A carriage arranged to walk along an elongate member while carrying a payload includes individually-operable clamps that are spaced axially along a common longitudinal axis. An axially-extensible frame connects the clamps. At least one of the clamps is attached to the frame via a rotationally-displaceable coupling for relative angular movement between that clamp and the frame about the longitudinal axis. The carriage can carry the payload to a subsea worksite by opening and closing the clamps to release and grip the elongate member in a sequence that includes moving the leading clamp forward when the leading clamp is open and moving the trailing clamp forward when the leading clamp is closed. At the worksite, installation force can be applied to the payload in a forward direction by moving the leading clamp forward when the leading clamp is open and the trailing clamp is closed.

25 Claims, 16 Drawing Sheets

(51) Int. Cl.
*B63C 11/52* (2006.01)
*B63G 8/00* (2006.01)

(56) References Cited

U.S. PATENT DOCUMENTS

| | | | | |
|---|---|---|---|---|
| 8,201,787 | B2 | 6/2012 | Ingram et al. | |
| 9,205,554 | B2 * | 12/2015 | Hayden | A01G 23/0955 |
| 9,498,881 | B2 * | 11/2016 | Hayden | A01G 23/0955 |
| 2013/0248679 | A1 * | 9/2013 | Hayden | A01G 23/0955<br>248/682 |

FOREIGN PATENT DOCUMENTS

| | | |
|---|---|---|
| GB | 2 335 181 | 9/1999 |
| GB | 2459874 | 11/2009 |
| GB | 2504605 | 2/2014 |
| KR | 2014-0135374 | 11/2014 |
| WO | WO 89/07071 | 8/1989 |
| WO | WO 2012/108765 | 8/2012 |
| WO | WO 2014/127931 | 8/2014 |

* cited by examiner

MOVING TOOLS ON OFFSHORE STRUCTURES WITH A WALKING CARRIAGE

This invention relates to remotely-operated subsea tools and to methods for moving such tools along elongate members of offshore structures. By moving along such members, tools of the invention can, for example, carry payloads to, and deploy or install payloads at, a worksite that may be underwater. This enables subsea intervention to be performed without necessarily using divers or ROVs.

References to tools in this specification include transporter tools whose primary task is to act as a vehicle or carriage that carries a payload between different locations on an offshore structure. For example, a payload may be carried from a point of origin to a subsea target location or destination on the structure and optionally back again. A payload may be integrated with such a tool or may be separable from the tool, for example to be placed at a target location, to be interchangeable or otherwise to be readily replaceable in a modular fashion.

The payload itself may comprise a secondary tool that is deployed by a transporter tool on arrival at the target location to carry out a particular task. Alternatively, a payload could be another item, such as a structural or protective item or an item of equipment, that a transporter tool places or installs at a target location and then leaves behind as the tool moves elsewhere.

In this specification, elongate members of offshore installations are exemplified by substantially vertical conductors, caissons and riser pipes, which are typically supported by offshore platforms as used in the subsea oil and gas industry. Tools of the invention are particularly suited to movement along generally upright and preferably vertical members like these, although in principle they could be also used on inclined or horizontal members of an offshore installation.

Conventionally, subsea intervention on an offshore platform is performed by divers if the platform is in sufficiently shallow water, up to about 200 m in depth. The alternative of simple ROV intervention is not practical in such situations. There is a considerable risk that the tether of an ROV will become entangled with members of the platform disposed in close proximity underwater or that an ROV will collide with those members due to motion of the sea.

Diver intervention on offshore platforms is costly and requires careful control of safety risks in such a congested subsea environment. For example, legislation in some countries forbids divers to work at night. Also, it can be dangerous for divers to work in the splash zone between the sea surface and a depth of about 10 m, where waves break on the structure of a platform.

Conversely, divers cannot operate subsea structures in water that is too deep. In addition, as the lifting capability of divers is limited, heavy equipment may have to be hoisted from the surface to near where divers are operating. This adds to the safety risks and complicates the task being performed, particularly when lowering the equipment through a turbulent splash zone.

It is well known to use robotic tools that attach to, or advance along, a subsea structure. For example, U.S. Pat. No. 3,717,000 discloses a supporting jig for a tool, namely a is robotic arm, for working on a pipeline. The jig comprises a series of clamps for attaching the jig to the pipeline. Displacement of the clamps adjusts the position of the jig relative to the pipeline. However, a manned submarine is required to lower the jig to the desired depth. This, of course, suffers many of the disadvantages of using an ROV, with the added disadvantage of risking human life.

GB 2202887 discloses a crawler for inspecting, cleaning or performing other tasks on welded joints of a horizontal tubular member of a subsea structure. The crawler comprises a saddle-like frame equipped with rollers that embraces the horizontal member. As the crawler moves along the member by rolling, its use is not feasible on an upright member.

KR 20140135374 discloses a robotic arm that can be displaced vertically along a leg of an offshore platform by a rack-and-pinion gear arrangement. However, this requires that the platform leg is pre-fitted with a toothed rack extending along its length, and constrains positioning of the arm to the straight path of the rack.

WO 2012/108765 discloses a robotic arm whose main purpose is to dismantle a platform jacket. The arm is lowered by an external hoisting system to be clamped at a desired position onto a structural member of the jacket, such as a brace or a leg. When necessary, the arm is moved to a different position on the jacket by the external hoisting system or by another similar arm. GB 2504605 discloses a variant of this arrangement in which robotic arms can move along a rail that is clamped in a fixed upright position to a leg of a platform jacket. Again, this constrains positioning of the arms to the straight path of the rail.

In WO 2014/127931, a lifting device is clamped onto a leg platform. The clamp can be used for raising and lowering the leg relative to a deck of the platform, for example to lower the leg into contact with the seabed and then to jack the platform up the leg. Other documents such as GB 2335181 show hand-over-hand clamp arrangements for the legs of a jack-up platform. The clamps are fixed relative to a deck of the platform and move along the leg to raise or lower the leg. This is the opposite purpose to the present invention, which aims to move a tool relative to all parts of a supporting structure such as the decks and legs of a platform.

U.S. Pat. No. 8,201,787 discloses walking clamp system that can be displaced along the mast or tower of a wind turbine. Clamping pressure is applied by clamp pads connected by flexible wire loops that encircle the mast. The clamp pads and the loops support a frame that also surrounds the mast. GB 2459874 describes another walking clamp system that can displace a crane along a wind turbine mast. In this instance, clamp pads are connected by arms via ball-joint couplings to a frame that surrounds the mast. However, both of these clamping mechanisms have a limited span: the clamp pads cannot open more than the frame size allows, meaning that the frame has to be adjusted or built to suit the maximum diameter of the mast.

None of the prior art disclosures summarised above is helpful for the purposes of the present invention. The invention provides a tool that can be mounted on an elongate upright member and that is capable of moving itself, when so mounted, both along and around the member. This capability to turn around the supporting member enables the tool to avoid obstacles on the member such as nodes, flanges or other projections by, for example, stepping around them in a process of circumferential or rotational walking. It also enables the tool to align a payload at a desired angular position with respect to a longitudinal axis of the supporting member, for example to hold a secondary tool at an appropriate orientation or to deposit an item in an appropriate orientation.

The genesis of the invention is a requirement for subsea intervention to be performed on vertical conductors, caissons and riser pipes supported by offshore platforms. Conductors are pipes or tubes, also known as I-tubes and J-tubes, that guide and protect hydrocarbon riser pipes. A conductor therefore defines the outer casing string of a borehole that extends from a deck of a production or drilling platform above the surface into the subsea bedrock beneath the platform to protect the riser. Consequently, conductors extend above and below the sea surface.

As they traverse the vertical distance between an above-surface deck of the platform and the sea bed, conductors typically pass through guide collars that brace the conductors against lateral movement under the influence of waves, current or wind.

Guide collars may be supported in one or more conductor guide frames that are supported in turn by the structure of the platform, such as the legs or braces of a jacket. Another conductor guide frame may be positioned subsea, for example on or near the seabed directly under the platform.

Typically an array of conductors extends vertically and in parallel between the seabed and a deck of the platform. In that case, the conductor guide frames have a matching array of guide collars that surround respective conductors to maintain correct spacing and alignment between the conductors.

Lateral motion of a conductor induced by waves, current or wind may cause it to impact or rub against a surrounding guide collar, potentially resulting in wear, fatigue and failure. This issue may be addressed by assembling a tubular wear sleeve around the conductor from two part-tubular halves and then interposing the wear sleeve between the conductor and the guide collar. Before the present invention, divers have had to perform this operation when installing wear sleeves in subsea guide collars.

Commonly, the tubular steel wall of a conductor has a seam weld extending along its length. During the subsea installation process, divers orient or reorient the wear sleeve, or the halves that make up the wear sleeve, to suit the angular position of the weld. Specifically, divers align the junction between the halves of the wear sleeve with the weld seam to embrace and accommodate the weld in a narrow gap between the halves.

Another challenge addressed by the invention is how to place the tool on a conductor or other upright elongate member positioned under the deck of a platform. There may be little space in which to operate and under-deck access may involve lowering the tool through a restricted opening in the deck.

Against this background, the invention resides in a carriage arranged to walk along an elongate member while carrying a payload. A payload may be integrated with the carriage and/or the carriage may comprise a payload support with which a payload is removably engageable.

The carriage comprises: individually-operable upper and lower, or first and second, clamps that are spaced axially along a common longitudinal axis around which the clamps can be closed; an axially-extensible frame connecting the clamps; and a walk drive acting on the frame, operable to extend and retract the frame in a direction parallel to the longitudinal axis to vary an axial distance between the clamps.

In accordance with the invention, at least one of the clamps is attached to the frame via a rotationally-displaceable coupling for relative angular movement between that clamp and the frame about the longitudinal axis.

For example, the rotationally-displaceable coupling may comprise a path curved around the longitudinal axis and a path follower arranged for relative movement along the path. In that case, the path may be defined by at least one curved slot and the path follower may comprise at least one pin engaged with the or each slot. More generally, the clamp preferably comprises a coupling part that is circumferentially-movable about the longitudinal axis relative to the frame.

Each clamp suitably comprises mutually-opposed jaws that are movable relative to the frame. The jaws preferably present concave-curved inner surfaces to the longitudinal axis when the clamps are closed, said curvature of those surfaces then preferably being substantially centred on the longitudinal axis. Each clamp may further comprise a backing plate coupled to the frame, which backing plate presents a concave-curved inner surface to the longitudinal axis, said curvature of that surface preferably being substantially centred on the longitudinal axis.

Advantageously, the jaws are pivotably attached to the backing plate. Actuators suitably act between the backing plate and the jaws to move the jaws relative to the backing plate.

For ease of handling, the jaws may be movable into a nested configuration in which one jaw lies between the backing plate and the other jaw. The jaws may also, or alternatively, be movable into an aligned configuration in which the jaws are substantially aligned with each other and with the backing plate disposed between them.

Where provided, a payload support advantageously comprises at least one pin with which a payload can be engaged by relative movement along the pin. That pin may extend transversely or substantially orthogonally to a plane containing the longitudinal axis. Preferably, parallel pins define a pair of forks.

The carriage preferably further comprises a payload interface drive operable to move the or each pin relative to the frame in a direction extending transversely or substantially orthogonally to the pin and to a plane containing the longitudinal axis. For example, the payload interface drive may be implemented in at least one module that is removably attachable to the frame, the module comprising an extensible member and a drive acting on the extensible member.

The carriage may further comprise one or more carriage guides on the frame, spaced axially from the clamps, defining a sliding or rolling bearing that is movable along and in contact with an elongate member held in the clamps, in use of the carriage.

The carriage of the invention may be used in combination with at least one payload interface element that is attachable to a payload and mechanically engageable with the carriage. Such a payload interface element may include torque tools for turning threaded fastener elements acting on the payload, and may conveniently be connected to a power supply of the carriage.

The inventive concept extends to a corresponding method of walking a carriage along an elongate member that contains a longitudinal axis. That method comprises: opening and closing leading and trailing clamps of the carriage to release and grip the elongate member in a sequence that includes moving the leading clamp forward when the leading clamp is open and moving the trailing clamp forward when the leading clamp is closed; and when either of the clamps is open, driving relative angular movement between the clamps around the longitudinal axis of the elongate member.

The carriage may be turned around the elongate member try driving relative angular movement between a clamp and the carriage when that clamp is closed and the other clamp is open. The method may, however, also involve driving relative angular movement between a clamp and the carriage when that clamp is open and the other clamp is closed. Relative angular movement between the open clamp and the carriage may take piece before, during or alter moving that clamp forward while it is open.

The inventive concept is also apt to be expressed in method terms as a method of installing a payload at a subsea worksite. That method comprises: carrying the payload to the worksite by walking a carriage along an elongate member, opening and closing leading and trailing clamps of the carriage to release and grip the elongate member in a sequence that includes moving the leading clamp forward when the leading clamp is open and moving the trailing clamp forward when the leading clamp is closed; and at the worksite, applying installation force to the payload in a forward direction by moving the leading clamp forward when the leading clamp is open and the trailing clamp is closed. The payload may be turned around the elongate member while being carried to the worksite or at the worksite, before the installation force is applied to the payload.

Advantageously, the carriage may be attached to the elongate member at an above-surface location before walking the carriage along the elongate member to a subsea location. The carriage may be assembled on the elongate member before walking the assembled carriage along the elongate member. Such attachment or assembly of the carriage is suitably preceded by lowering the carriage in a collapsed or disassembled form to the elongate member from a deck level above the elongate member.

A payload is preferably engaged with the carriage after attaching the carriage to the elongate member. For example, a payload may be engaged with the carriage by moving the payload relative to a payload support of the carriage in a direction transverse to or substantially orthogonal to the walking direction. Conversely, a payload may be disengaged from the carriage by moving a payload support of the carriage relative to the payload in a direction transverse to or substantially orthogonal to the walking direction. The disengagement direction need not be on the same axis as the engagement direction and indeed may be transverse to or substantially orthogonal to that axis.

A payload support of the carriage may be moved in a direction transverse to or substantially orthogonal to the walking direction while attached to the payload. Preferably, paired payload supports are moved in opposite directions transverse to or substantially orthogonal to the walking direction, to separate or to bring together portions of the payload. For example, portions of the payload may be brought together around the elongate member.

In summary, a carriage in accordance with the invention is arranged to walk along an elongate member while carrying a payload. The carriage comprises individually-operable clamps that are spaced axially along a common longitudinal axis. An axially-extensible frame connects the clamps. At least one of the clamps may be attached to the frame via a rotationally-displaceable coupling for relative angular movement between that clamp and the frame about the longitudinal axis.

The carriage can carry the payload to a subsea worksite by opening and closing the clamps to release and grip the elongate member in a sequence that includes moving a leading clamp forward when the leading clamp is open and moving a trailing clamp forward when the leading clamp is closed. At the worksite, installation force can be applied to the payload in a forward direction by moving the leading clamp forward when the leading clamp is open and the trailing clamp is closed.

In preferred embodiments, the inventive concept finds expression in a walking assembly that can be displaced along a static vertical member of an offshore platform to carry tools that perform maintenance and repair operations on that platform. The walking assembly is suitably hydraulically powered and may comprise its own electrically-powered hydraulic power unit or HPU.

In those embodiments, the walking assembly comprises upper and lower clamps that enable friction clamping onto the vertical member, with each clamp being capable of exerting sufficient clamping force on its own to support the weight of the assembly. At least one interconnecting member connects the upper and lower clamps substantially in an axial direction defined by the vertical member. A displacement mechanism modifies the distance between the clamps along the interconnecting member to walk the assembly along the vertical member to a required water depth. At least one of the clamps comprises means for imparting rotational offset to that clamp relative to the interconnecting member and the other clamp. Rotation may, for example, be of an open clamp around the vertical member or of the assembly around a closed clamp.

At least one tool-carrying interface such as a pin, arm or fork is suitably arranged to support one or more tools. A tool may be coupled to a pin by a sliding arrangement. The assembly preferably comprises two tool-carrying pins in a parallel fork arrangement. The pins are static for a tool to be coupled to them but can preferably move relative to the remainder of the walking assembly thereafter.

Either or both of the clamps may comprise a support or backing plate, at least two rotatable clamping arms or jaws hinged to the support plate, and actuating means for rotating the clamping arms relative to the support plate.

The clamps can open transversely with respect to the vertical member to a spacing substantially greater than the diameter of the vertical member, enabling the walking assembly to pass obstacles such as flanges or nodes on the vertical member. For example, opposite tips of the rotatable clamping arms may be opened to a spacing greater than 1.5 times the diameter of the vertical member.

The walking assembly may carry a wear sleeve installation tool for carrying two half wear sleeves whose internal diameter matches the external diameter of the vertical member. The tool may comprise a clamping frame to open or close the wear sleeve transversely by separating or bringing together the two halves. The walking assembly may carry various other tools such as a cutting tool or a cleaning tool, which may be interchanged between operations to be used sequentially by the same walking assembly.

At least one of the clamps may comprise a pivot arrangement such as a gimbal or elastomer pad for accommodating an angle with the vertical, which angle may be up to 10°.

The walking assembly may be controlled through a wired or wireless data connection from the surface or from an ROV that stands off from the assembly. Alternatively some or all operations can be automatically assisted or performed by an onboard control system mounted on the walking assembly.

In a preferred embodiment to be described, a transport tool of the invention comprises: upper and lower walk clamps; a walk cylinder; a clamp carriage and rotate mechanism and a payload interface. The tool is hydraulically-and/or electrically-powered and remotely-operated to deploy payloads to a predetermined worksite, which may be subsea.

The walking assembly is powered a hydraulic or electric power supply, provided from the surface or supplied by an ROV, by onboard batteries or by any other power supply known in the art. The tooling carried by the walking assembly may comprise an independent power source, may be powered by the walking assembly or may be powered from the surface.

The tool of the invention is deployed onto a pipe or other elongate element above or below the waterline and walks along the pipe to a subsea worksite by repeated sequential operation of the upper and lower walking clamps, interposed with extension and retraction of the walk cylinder. The tool has the ability to rotate, allowing the tool to walk circumferentially around the pipe to which it is connected. The tool ensures that the payload is concentric to the pipe when the payload interface is in a retracted or closed position.

The tool can operate on two different pipe diameters at any one time so that it can walk past or clamp onto obstructions such as projections on the pipe. Concentricity between the payload and the pipe is maintained when the payload interface is in a retracted position. Nevertheless, the payload interface can be extended to move the payload away from the pipe centreline to allow the payload to clear obstructions on the pipe.

In order that the invention may be more readily understood, reference will now be made, by way of example, to the accompanying drawings in which.

Figure 1:
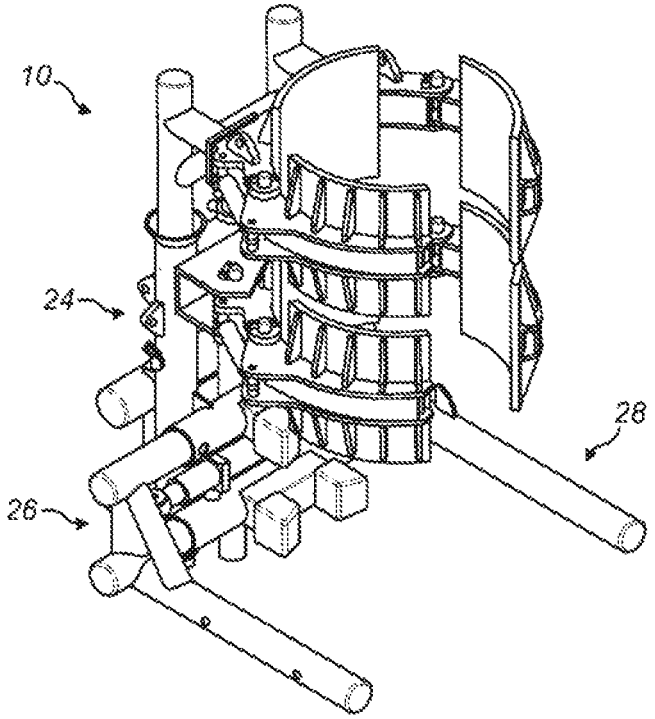
FIG. 1 is a front perspective view of a carriage in accordance with the invention.
Figure 2:
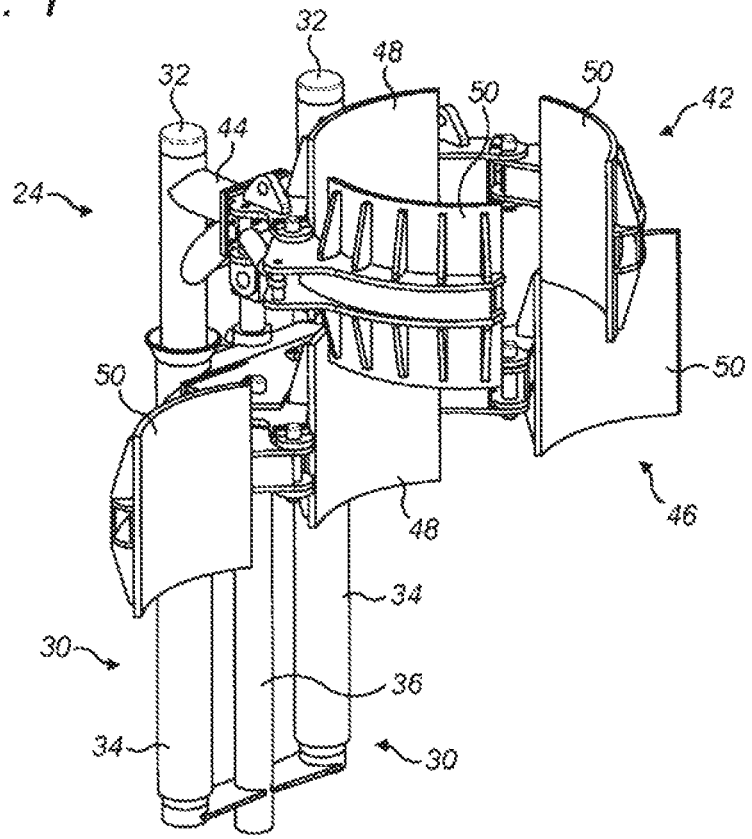
FIG. 2 is a front perspective view of walk module of the carriage of FIG. 1.
Figure 3:
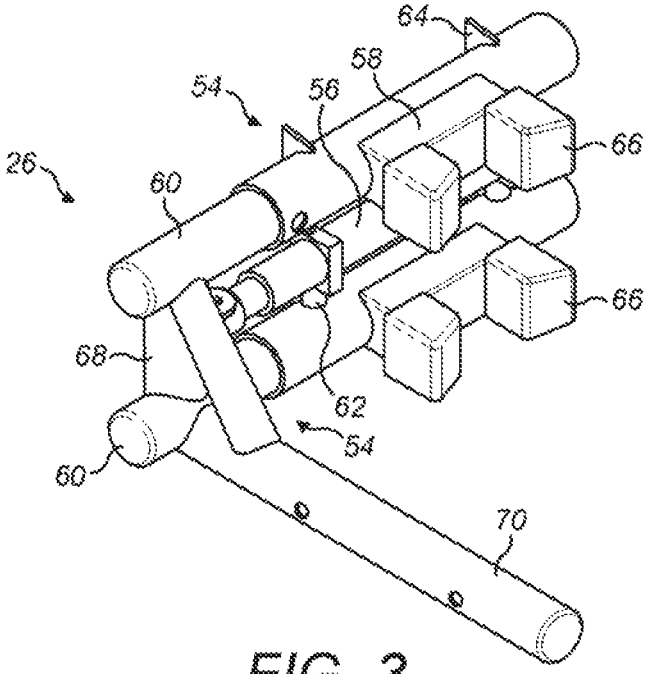
FIG. 3 is a front perspective view of a first payload interface module of the carriage of FIG. 1.
Figure 4:
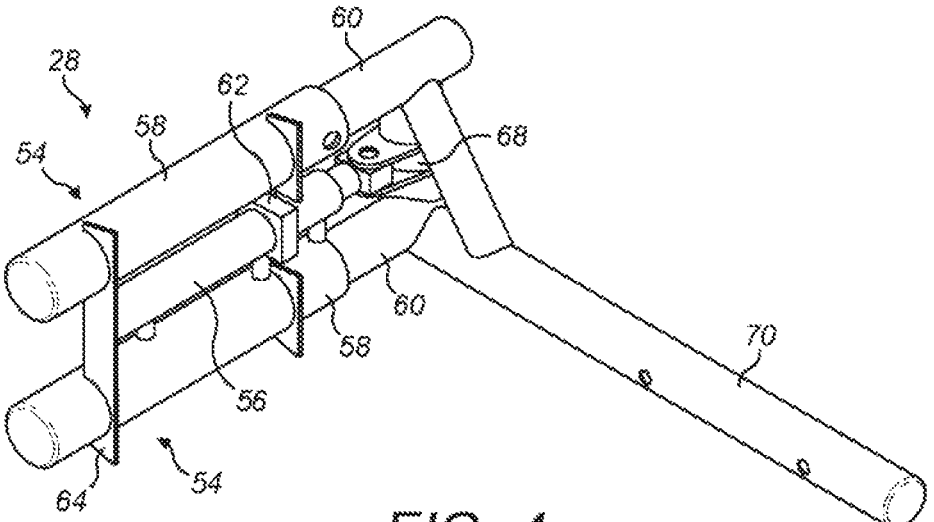
FIG. 4 is a front perspective view of a second payload interface module of the carriage of FIG. 1.
Figure 5:
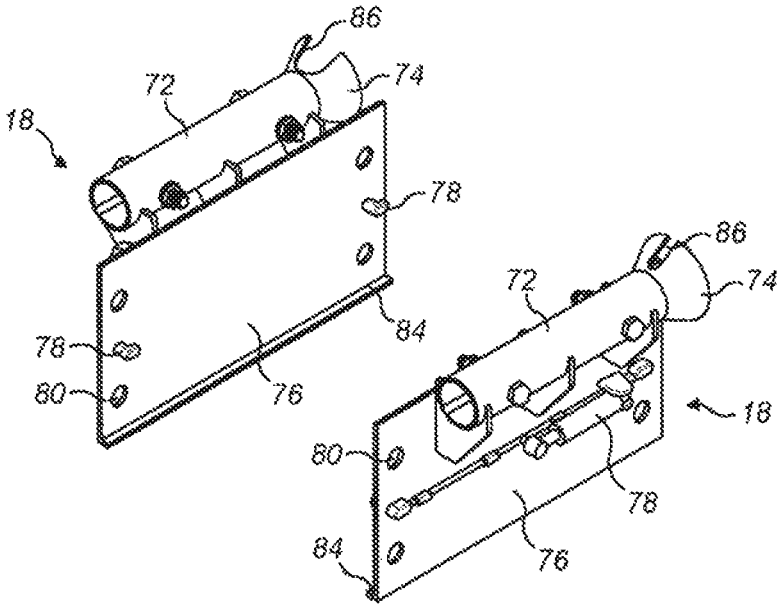
FIG. 5 is a front perspective view of a pair of tooling plates that are cooperable with the carriage of FIG. 1.
Figure 6:
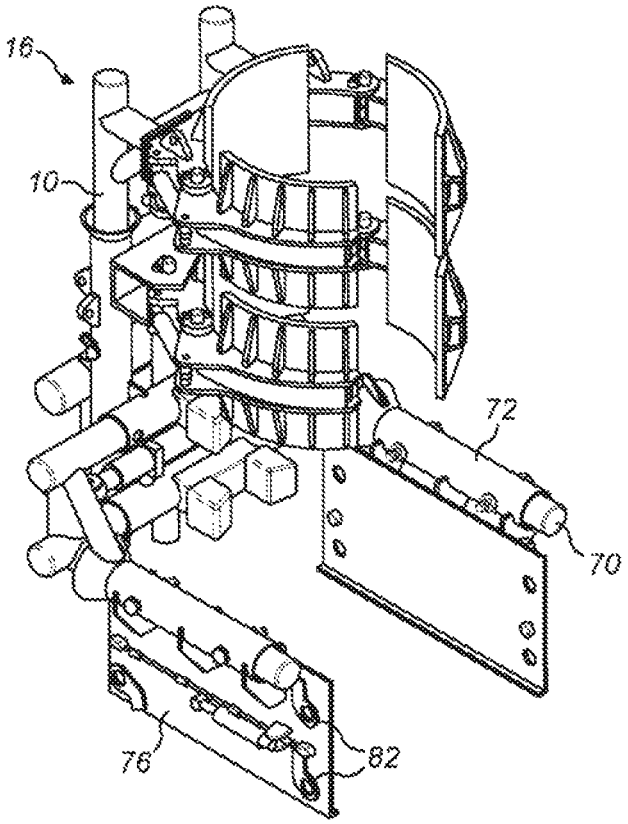
FIG. 6 is a front perspective view of a carriage assembly comprising the carriage of FIG. 1 engaged with the tooling plates of FIG. 2.
Figure 9:
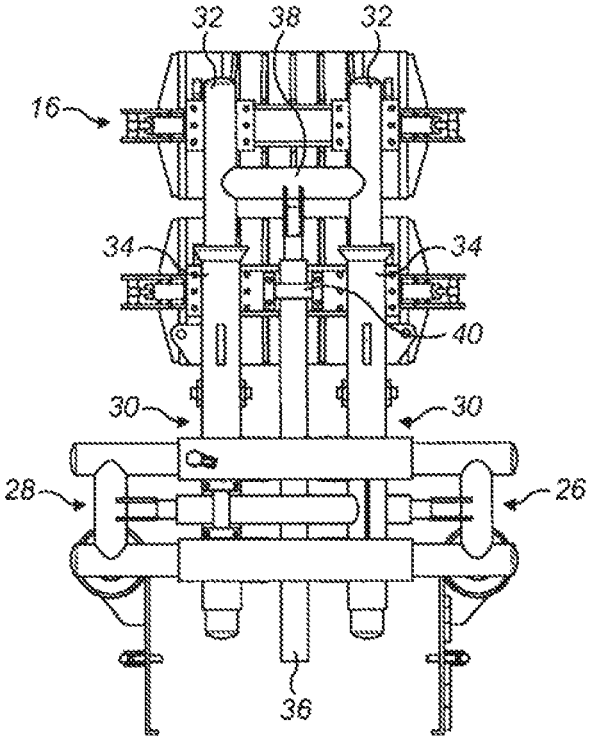
FIG. 9 is rear elevation view of the carriage assembly of FIGS. 6 to 8.
Figure 10:
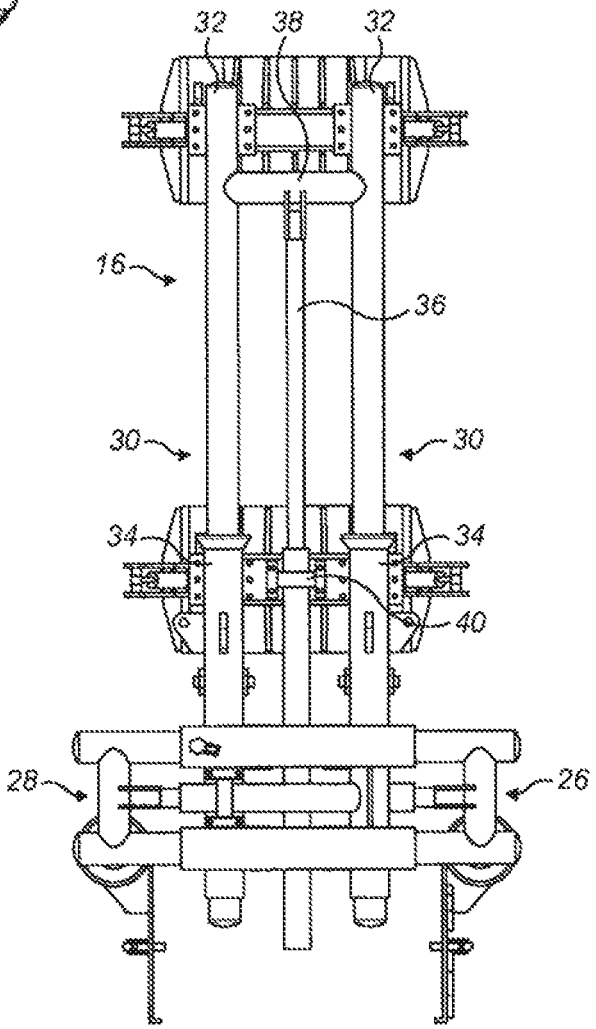
Figure 11:
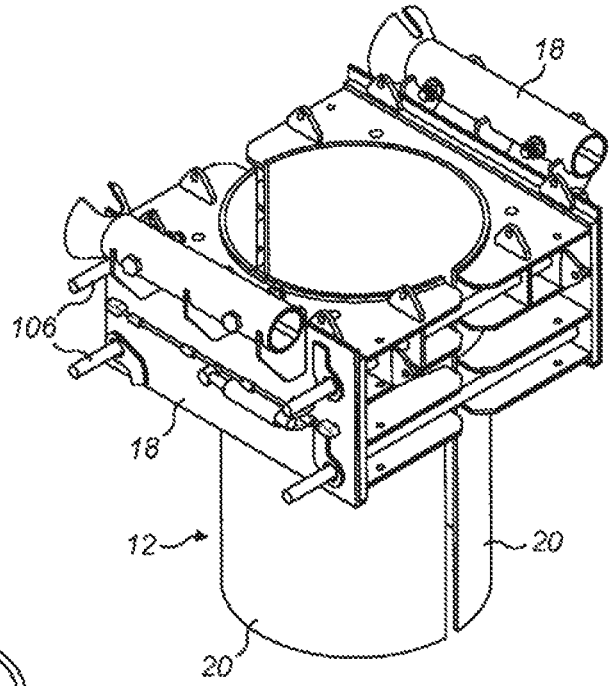
Figure 12:
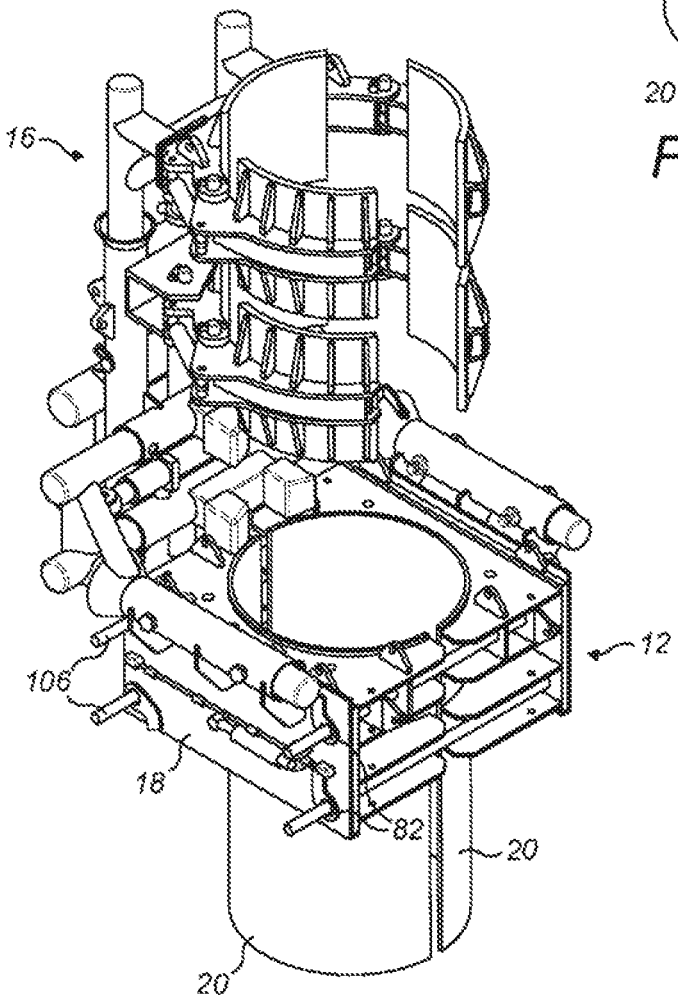
Figure 13:
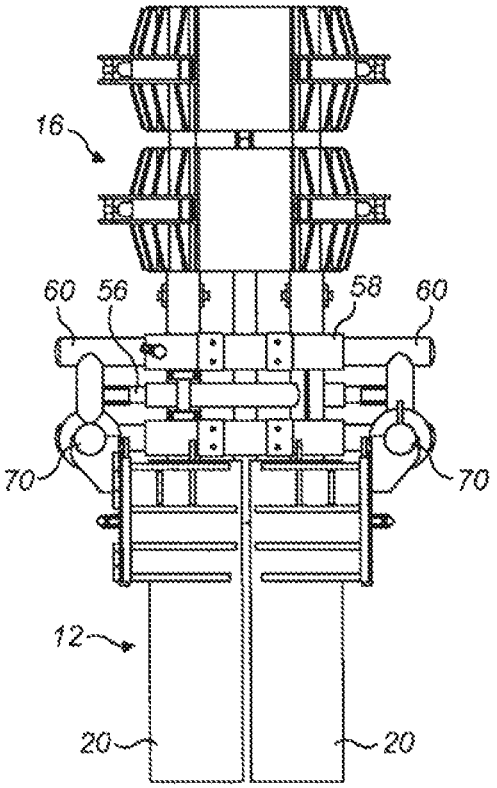
Figure 14:
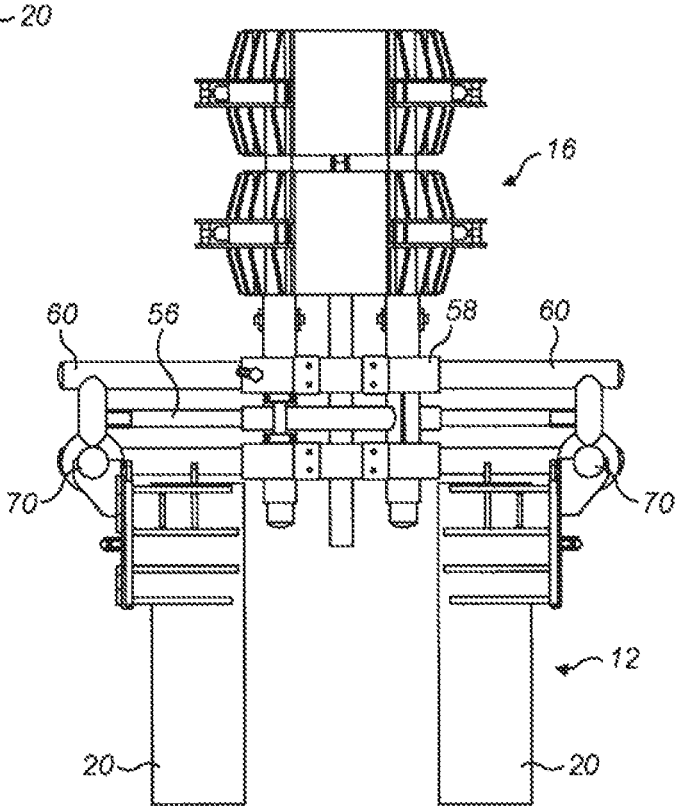
Figure 20:
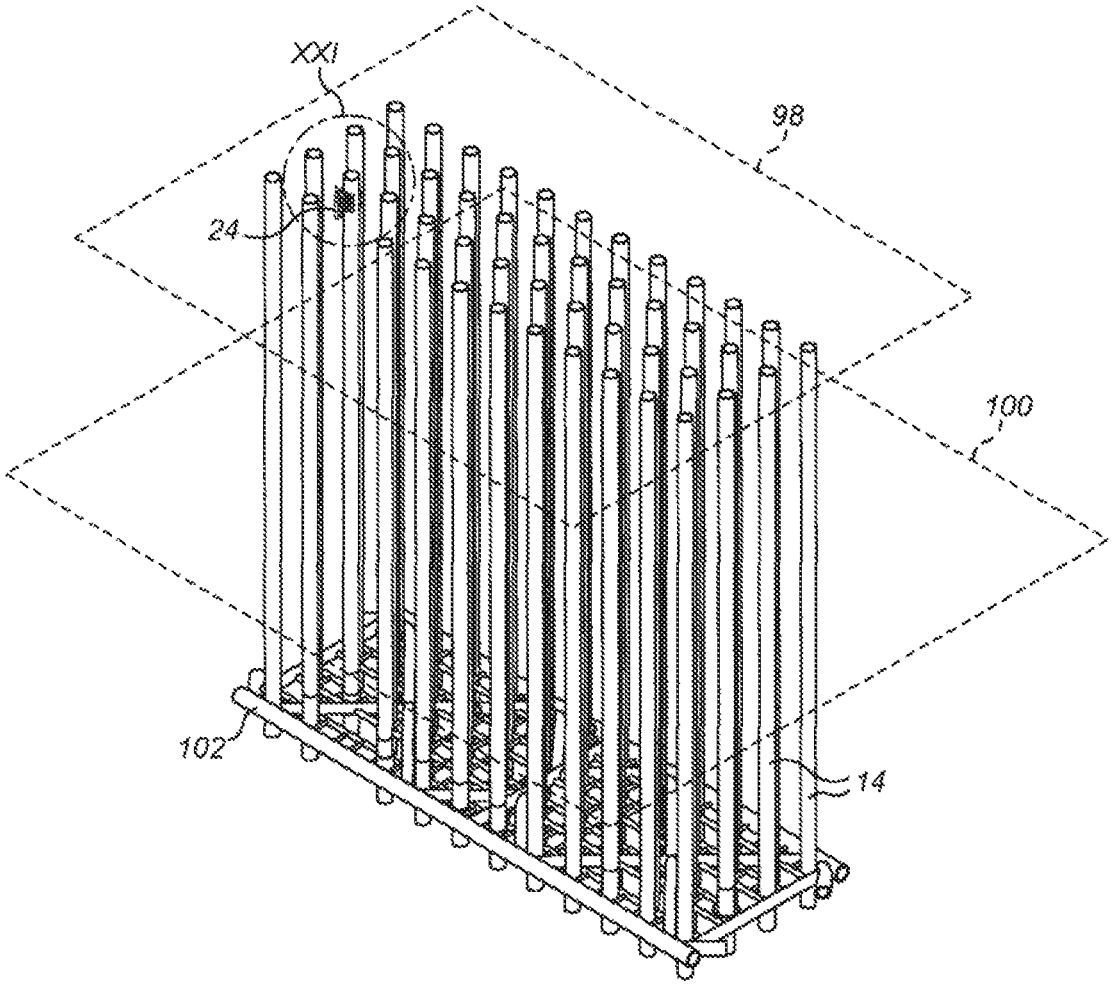
Figure 22:
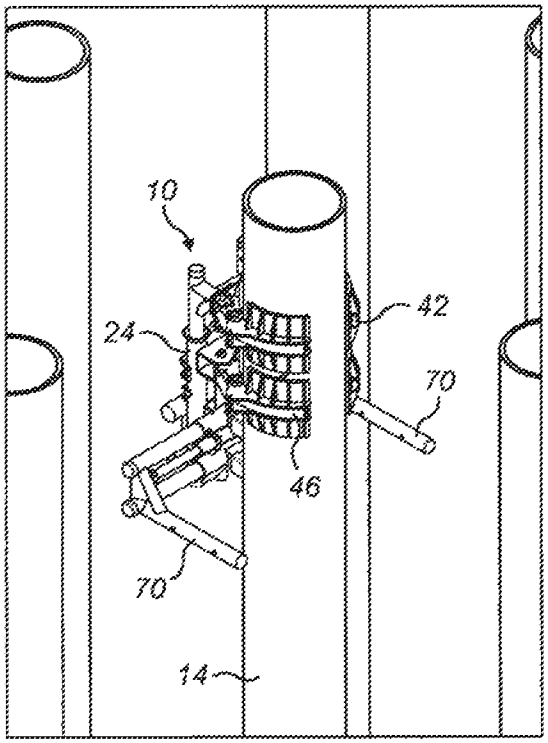
Figure 21:
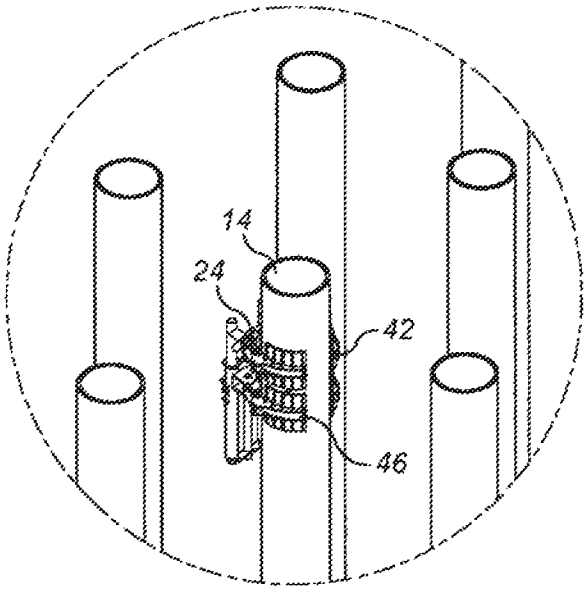
Figure 24:
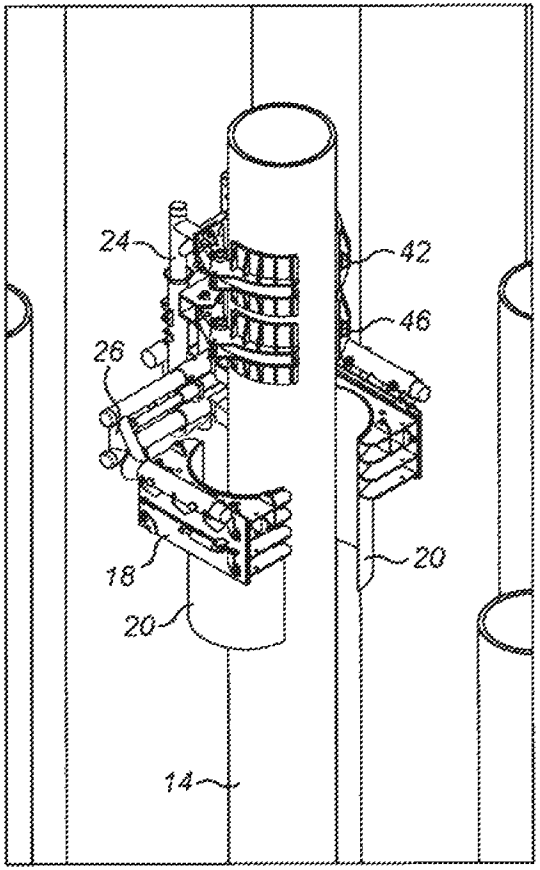
Figure 23:
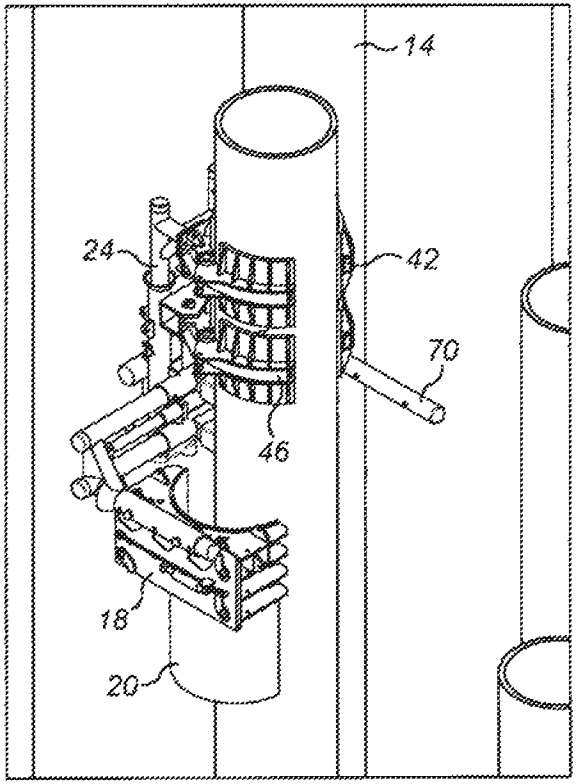
Figure 26:
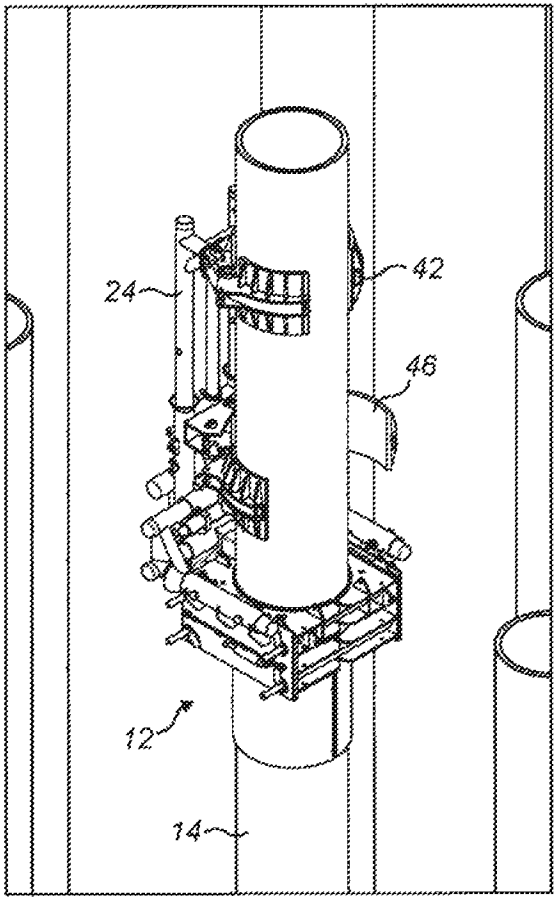
Figure 25:
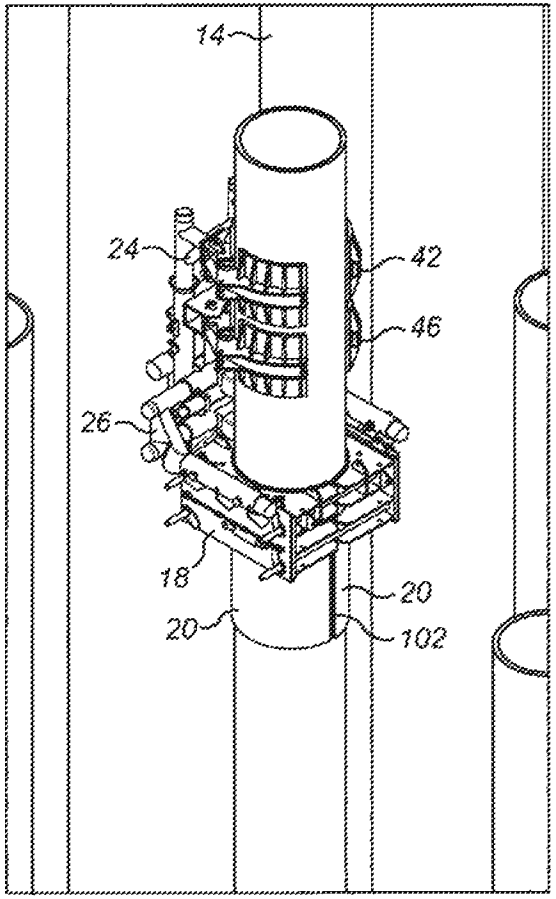
Figure 28:
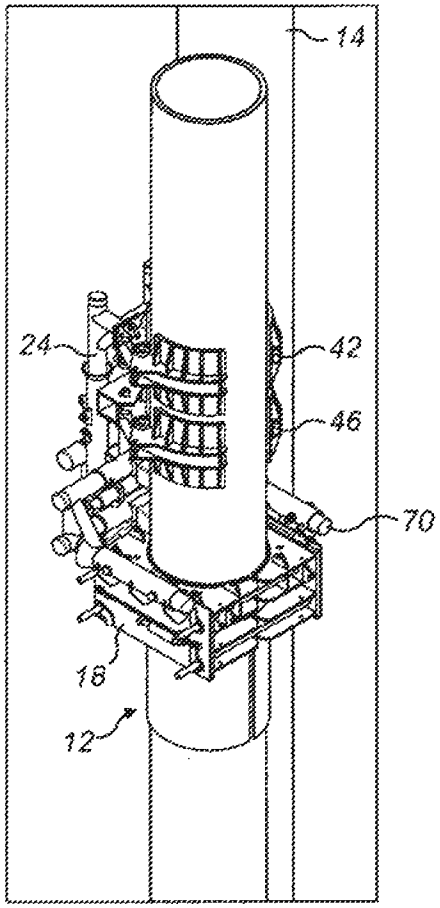
Figure 27:
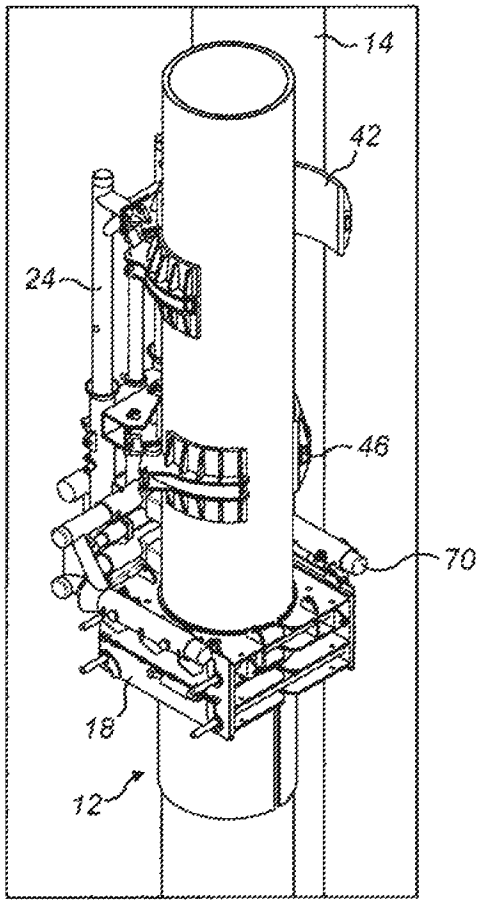
Figure 30:
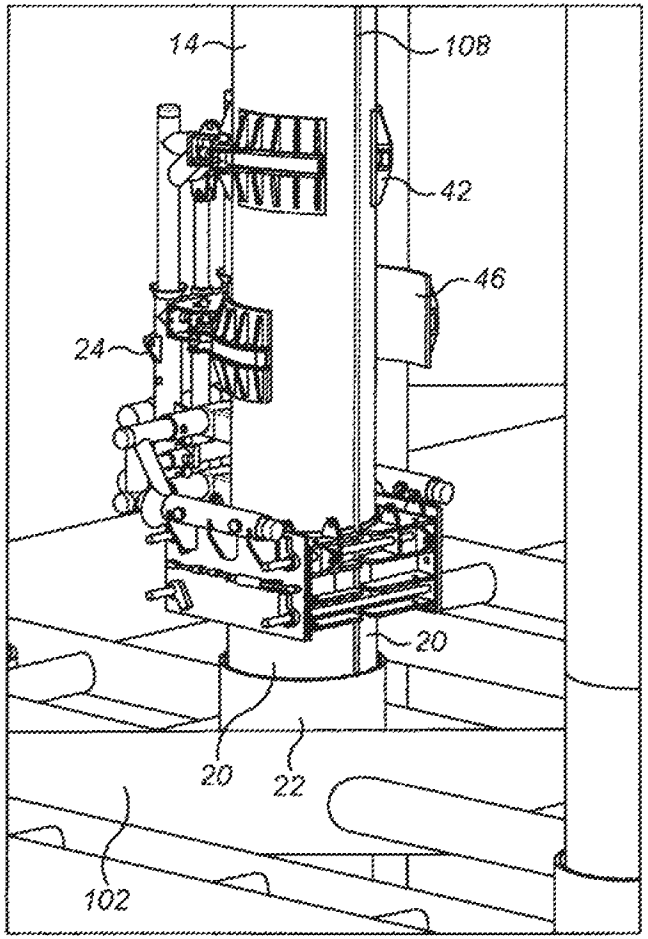
Figure 29:
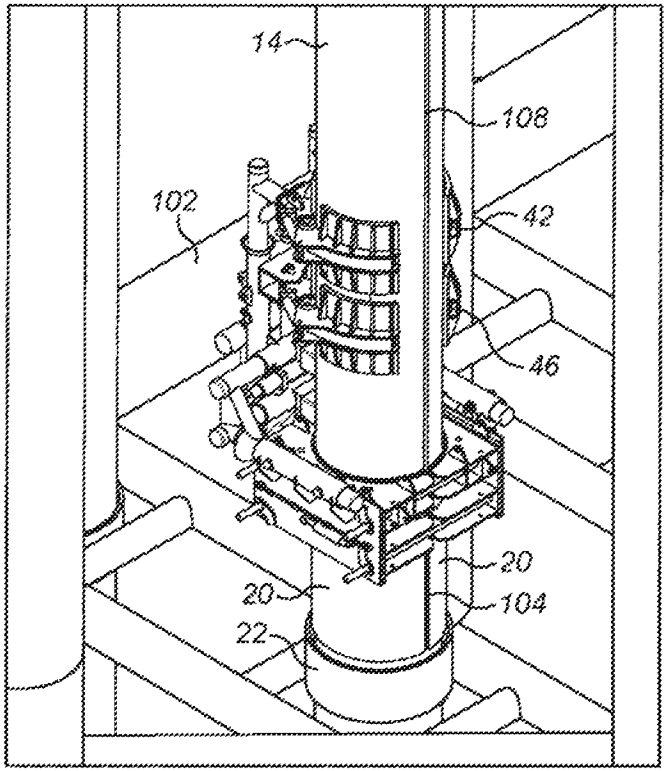
Figure 31:
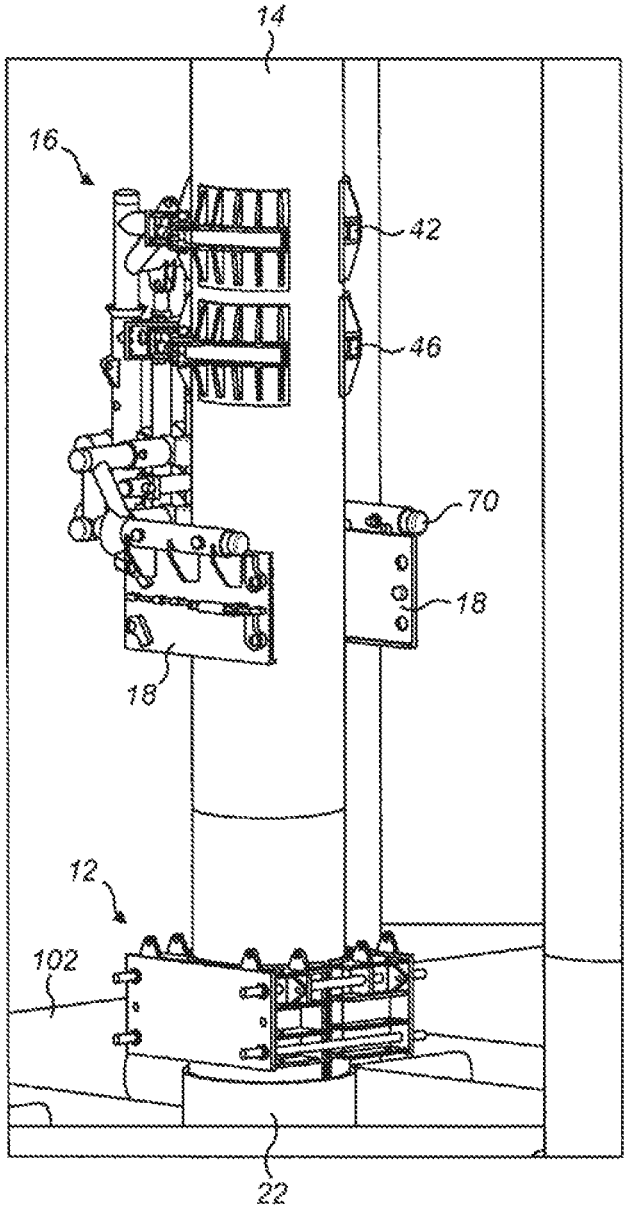

FIG. 10 corresponds to FIG. 9 but shows the carriage of the assembly with walk cylinders of the walk module in a vertically-extended configuration;

FIG. 11 is a front perspective view of payload fitted the tooling plates of FIG. 5;

FIG. 12 is a front perspective view of the carriage assembly of FIG. 6 supporting the payload of FIG. 11 via the tooling plates;

FIG. 13 is a front elevation view corresponding to FIG. 9;

FIG. 14 corresponds to FIG. 13 but shows the carriage of the assembly with payload interface cylinder 56*s* in a horizontally-extended configuration in which halves of the payload are separated;

FIGS. 15 to 19 are enlarged detail plan views of a lower walk clamp 46 of the carriage in various modes and configurations;

FIG. 20 is a perspective view of an array of conductors of an offshore installation, one of which supports a walk module as shown in FIG. 2;

FIG. 21 is an enlarged perspective view corresponding to detail XXI of FIG. 20;

FIG. 22 is a further enlarged perspective view owing the carriage of FIG. 1 completed by attaching the payload interface modules of FIGS. 3 and 4 to the walk module that is clamped to a conductor;

FIG. 23 corresponds to FIG. 22 but shows one half of a payload fitted with one of the tooling plates of FIG. 5, attached to one of the payload interface modules via that tooling plate;

FIG. 24 corresponds to FIG. 23 but shows the other half of the payload fitted with the other tooling plate of FIG. 5, attached to the other payload interface module via that tooling plate;

FIG. 25 corresponds to FIG. 24 but shows the halves of the payload pushed together around the conductor by retraction of the payload interface modules;

FIGS. 26 to 28 are a sequence of views corresponding to FIG. 25 but showing the walk module of the carriage performing a walk cycle along the conductor to lower the payload toward a subsea worksite;

FIG. 29 corresponds to FIG. 28 but shows the payload brought by the carriage to the subsea worksite, at which the payload is aligned with a longitudinal weld seam of the conductor;

FIG. 30 corresponds to FIG. 29 but shows the payload being inserted by the carriage between the conductor and a surrounding guide collar; and FIG. 31 corresponds to FIG. 30 but shows the tooling plates decoupled from the payload and being walked by the carriage upwardly along the conductor away from the worksite.

Reference is made firstly to FIGS. 1 to 14. In these drawings, FIGS. 1, 6 to 10 and 12 to 14 show a carriage 10 in accordance with the invention. As will be explained, the carriage 10 serves as a transport tool to move a payload 12 along an upright elongate member of an offshore structure, which member is exemplified in later drawings as a conductor 14. In so doing, the carriage 10 delivers the payload 12 to a subsea target location, preferably from a starting point above the sea surface.

FIG. 1 shows the carriage 10 in isolation. FIGS. 6 to 10 show the carriage 10 as part of a carriage assembly 16, which also comprises a pair of tooling plates 18 that are engageable with the carriage 10. FIGS. 12 to 14 show the carriage assembly 16 supporting a payload 12 via the tooling plates 18 engaged with the carriage 10. The payload 12 in this example is a tubular wear sleeve 12 that is assembled around the conductor 14 from two part-tubular halves 20, to be interposed between the conductor 14 and a surrounding guide collar 22 at the subsea target location, shown in FIGS. 29 to 31.

FIGS. 2, 3 and 4 show modules that make up the carriage 10 when assembled together. FIG. 5 shows the pair of tooling plates 18 in isolation, whereas FIG. 11 shows the payload 12 fitted with the tooling plates 18, ready to be engaged with the carriage 10.

The carriage 10 shown in FIG. 1 comprises a walk module 24 shown in isolation in FIG. 2, a first payload interface module 26 shown in isolation in FIG. 3 and a second payload interface module 28 shown in isolation in FIG. 4. The modular construction of the carriage 10 eases its deployment because the modules 24, 26, 28 can be installed separately. Performing sequential deployment operations on the respective modules 24, 26, 28 reduces the deployment weight for each lift and minimises the spatial envelope. This allows the modules 24, 26, 28 to pass through a smaller access opening, such as a deck access hatch, than a carriage 10 could pass through if pre-assembled.

FIG. 2 shows that the walk module 24 comprises a pair of telescopically-extensible parallel uprights 30. Each upright 30 comprises an upper member 32 and a lower member 34 in concentric telescopic relation. In this example, the lower member 34 surrounds the upper member 32 although, in principle, that arrangement could be reversed.

A hydraulic walk cylinder 36 is disposed between the uprights 30 in parallel co-planar relation. The uprights 30 are joined at intervals by cross-members that also support the walk cylinder 36, such that the length of the uprights 30 may be adjusted by extension or retraction of the walk cylinder 36. This varies the distance between an upper cross-member 38 joining the upper members 32 of the uprights 30 and a lower cross-member 40 joining the lower members 34 of the uprights 30. This is best appreciated in FIGS. 9 and 10. Thus, the walk cylinder 36 provides a tool extension feature to able the carriage 10 to walk along a conductor 14 and to push or pull the wear sleeve 12 into or out of its position at the subsea target location.

An upper walk clamp 42 is supported by a pair of outriggers 44 extending forwardly from the upper members 32 of the uprights 30, above the upper cross-member 38. The upper walk clamp 42 performs the upper clamp function of the walk feature and also provides a reaction force for deploying the payload 12, such as inserting a wear sleeve 12 between a conductor 14 and a surrounding guide collar 22.

The lower cross-member 40 joining the lower members 34 of the uprights 30 supports a lower walk clamp 46. The lower walk clamp 46 performs the lower clamp function of the walk feature.

Additionally, as will be explained later, either or both of the upper and lower walk clamps 42, 46 have a rotation function. Only the lower walk clamp 46 has a rotation function in the embodiment shown, as will be explained further with reference to FIGS. 15 to 19. In this example, the main purpose of the rotation function is to orient a wear sleeve 12 to suit the angular position of a longitudinal weld seam extending along a conductor 14. This enables a gap between halves 20 of the wear sleeve 12 to be aligned with the weld seam to accommodate it in the gap.

The upper and lower walk clamps 42, 46 each comprise amp elements. The clamp elements have concave internal curvature that matches e external curvature of a conductor 14 to which the carriage 10 is intended to be clamped.

The clamp elements of each of the upper and lower walk clamps 42, 46 comprise a central concave backplate 48 between a pair of outer jaws 50 that are pivotable with respect to the backplate 48. The jaws 50 hinge about respective pivot axes that are parallel to the uprights 30 and the walk cylinder 36. In this example, pivotal movement of the jaws 50 is driven by double-acting hydraulic rams 52 that act between the jaws 50 and the backplate 48 to close and open the jaws 50 and hence to grip and release the conductor 14 in use.

The rams 52 are hydraulically controlled so that the jaws 50 can move to and be held at any angular position within a predetermined range: the jaws 50 are not limited to be only either fully open or fully closed. It will also be noted that the range of movement of the jaws 50 is limited only by the geometry of their hinged connections to the backplate 48 and the rams 52. Thus, the ability of the upper and lower walk clamps 42, 46 to engage with an elongate member such as a conductor 14 is not limited by other factors such as a requirement for a frame surrounding the conductor 14.

Each of the first and second payload interface modules 26, 28 shown in FIGS. 3 and 4 comprises a pair of laterally-extensible telescopic parallel rods 54. When the carriage 10 is assembled as shown in FIG. 1, the rods 54 extend substantially orthogonally with respect to the uprights 30 and the walk cylinder 36. A hydraulic payload interface cylinder 56 is disposed between the rods 54 in parallel co-planar relation. The rods 54 are joined at longitudinal intervals by cross-members that also support the payload interface cylinder 56, such that the length of the rods 54 may be adjusted by extension or retraction of the payload interlace cylinder 56. This is shown in FIGS. 13 and 14.

Each rod 54 of the payload interface modules 26, 28 comprises an inboard member 58 and an outboard member 60 in concentric telescopic relation. In this example, the inboard member 58 surrounds the outboard member 60 although, again, that arrangement could be reversed.

Inboard cross-members 62 join the inboard members 58 of the rods 54, which include interface formations 64 to attach the payload interface modules 26, 28 to the walk module 24 upon assembly. The first payload interface module 26 is attached to the front of the uprights 30 whereas the second payload interface module 28 is attached to the rear of the uprights 30. More specifically, the payload interface modules 26, 28 attach to the lower members 34 of the uprights 30 of the walk module 24. Thus, the lower members 34 of the uprights 30 are sandwiched between, and are orthogonal with respect to, the inboard members 58 of the payload interface modules 26, 28.

The first payload interface module 26 shown in FIG. 3 also includes an array of carriage guides 66 attached to the inboard members 58 of its rods 54 on their front side. The carriage guides 66 collectively present a sliding bearing surface to a conductor 14 and so have concave-curved, inclined ends to match the external curvature of the conductor 14. Their purpose is to slide along the conductor 14 to guide movement of the carriage 10 and to support the carriage 10 when the lower walk clamp 46 is open, reacting to the moment generated by the offset centre of gravity when the walk module 24 extends.

In the example shown, the carriage guides 66 are blocks of a low-friction material such as nylon. Wheels or rollers could instead serve as carriage guides to cope with obstacles, defects or irregularities on the external surface of the conductor 14, such as longitudinal or circumferential weld seams.

In each of the payload interface modules 26, 28, an outboard cross-member 68 joining the outboard members 60 of the rods 54 supports a cantilevered fork 70 that serves as a payload interface. The fork 70 extends orthogonally with respect to the rods 54 and has a circular cross-section. The fork 70 of the first payload interface module 26 shown in FIG. 3 is shorter than the corresponding fork 70 of the second payload interface module 28 shown in FIG. 4 because the payload interface modules 26, 28 are attached to opposite sides of the walk module 24. When the carriage 10 is assembled, the forks 70 form a parallel pair and extend forwardly to a similar extent as shown in FIG. 1.

Figure 7:
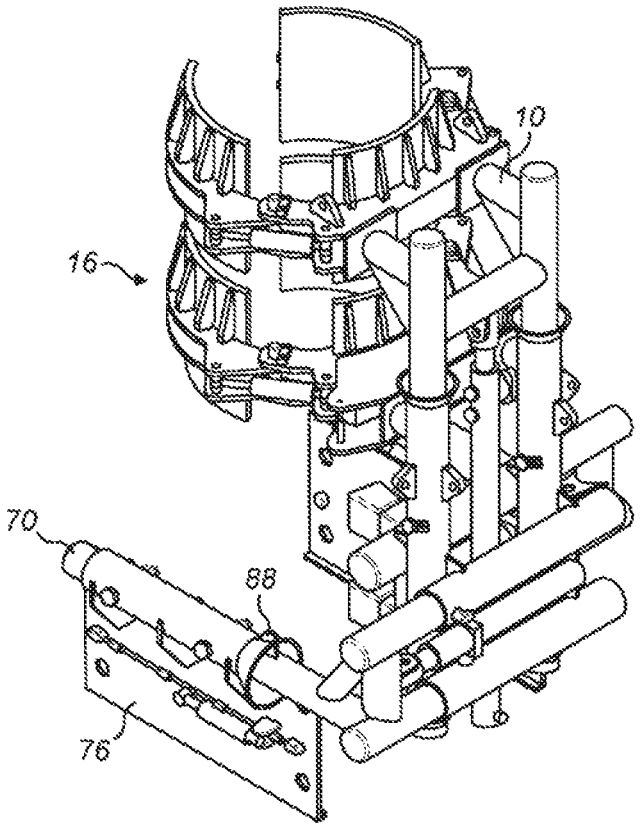
FIG. 7 is a rear perspective view of the carriage assembly of FIG. 6.
Figure 8:
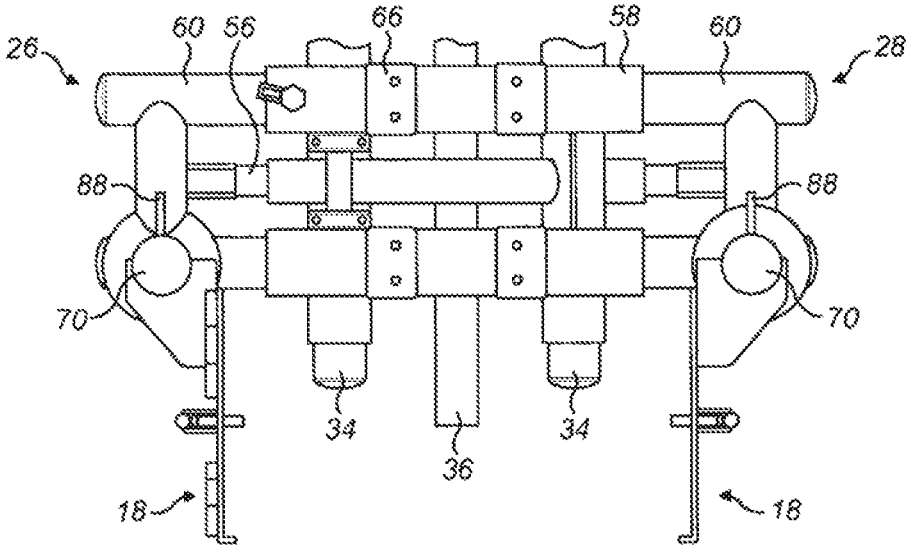
FIG. 8 is an enlarged front detail elevation view of the carriage assembly of FIGS. 6 and 7.

Turning next to FIG. 5, this shows a pair of tooling plates 18 that are cooperable with the carriage 10 by virtue of engagement with the respective forks 70. This forms a carriage assembly 16 as best shown in FIGS. 6, 7 and 8. To this end, each tooling plate 18 comprises a tubular sleeve 72 with a flared end cone serving as a guide funnel 74 to ease alignment and insertion of the fork 70 into the sleeve 72.

An interface 76 hangs from the sleeve 72 of each tooling plate 18 to enable the tooling plate 18 to interface the payload 12 to the carriage 10. The interface plate 76 includes a latch mechanism 78 and holes 80 for bolt tooling to interface with the payload 12, as will be explained. Hydraulic torque tools 82 are shown surrounding the holes 80 in FIGS. 6 and 7. The interface plate 76 also has a lower lip 84 to engage under an edge of, and hence to give additional support to, a payload such as a wear sleeve 12.

Each guide funnel 74 has a cut-out key opening 86. FIGS. 6, 7 and 8 show how the key openings 86 receive key formations 88 projecting radially from the forks 70 to lock the tooling plates 18 against rotation around the forks 70. This keyed engagement holds the interface plates 76 in the correct orientation, in parallel planes in this example. The key openings 86 and the complementary key formations 88 differ between the forks 70 and the tooling plates 18 so that the correct tooling plates are engaged with the correct forks 70.

The latch mechanisms 78 of the tooling plates 18 are hydraulically actuated. When engaged, the latch mechanisms 78 engage with the halves 20 of a wear sleeve 12 to allow the carriage 10 to push and pull the halves 20 together and apart. When the latch mechanism 78 are disengaged, the tooling plates 18 can be removed from the halves 20 of the wear sleeve 12 after installation.

FIGS. 9 and 10 show the carriage assembly 16 from the rear, with the walk module 24 of the carriage 10 in retracted and extended states respectively. It will be noted from FIG. 10 that the walk cylinder 36 has been extended to bear against the upper cross-member 38 that joins the upper members 32 of the uprights 30 and that supports the upper walk clamp 42. This drives the upper and lower walk clamps 42, 46 apart, enabled by telescopic extension of the uprights 30.

FIG. 11 shows the halves 20 of a wear sleeve 12 brought together and fitted with the tooling plates 18, ready to be engaged with the carriage 10 as shown in FIG. 12. The tooling plates 18 are fitted to each half 20 of the wear sleeve 12 before lifting them from the deck of a platform to the carriage 10 on a conductor 14 under the deck. Each tooling plate 18 is attached to a backing plate of a respective half 20 of the wear sleeve 12. In addition to actuating the latch mechanisms 78 of the interface plates 76 hydraulically, temporary installation pins are installed between the tooling plate 18 and the wear sleeve 12 as a safety precaution.

Heavy-duty bolts are fitted between tooling plates 18 and the payload interface forks 70 to lock the halves 20 of the wear sleeve 12 in place. Hydraulic lines are then fitted.

FIGS. 13 and 14 show the carriage assembly 16 from the front, with the payload interface modules 26, 28 of the carriage 10 in retracted and extended states respectively. It will be noted from FIG. 14 that the payload interface cylinder 56 has been extended to bear against the outboard cross-members 68 that join the outboard members 60 of the rods 54. This drives the forks 70 apart, enabled by telescopic extension of the rods 54. Consequently, the halves 20 of the wear sleeve 12 are pulled apart to allow them to be placed around a conductor 14 before being pushed back together again to surround the conductor 14. The halves 20 can then be bolted together on installation of the wear sleeve 12, whereupon the forks 70 can again be driven apart to pull the tooling plates 18 clear of the halves 20 after unlatching.

In addition to initial connection of the halves 20 of the wear sleeve 12 by pushing together the forks 70 and by bolting, a jacking system may be integrated in the upper part of the wear sleeve to tension the bolts that perform final closure. The jacking system could be connected to the carriage assembly 16 but need not be.

Turning next to FIGS. 15 to 19, these show various modes and configurations of the lower walk clamp 46, which as noted above has a rotation function as shown in FIG. 17. The upper walk clamp 42 could also, or instead, have a rotation function. In this example, the upper walk clamp 42 does not have a rotation function but it has the other modes of operation shown in FIGS. 15, 16, 18 and 19.

FIGS. 15 to 19 show the clamp elements of the lower walk clamp 46 in plan view, namely the central backplate 48 attached to the lower cross-member 40, flanked by the outer jaws 50 that pivot with respect to the backplate 48 when driven by the hydraulic rams 52 that act between the jaws 50 and the backplate 48.

Figure 15:
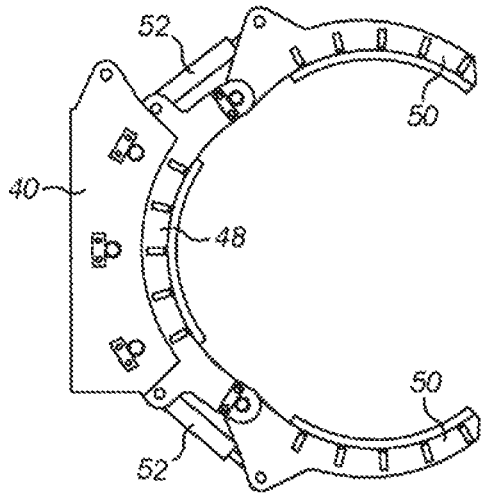

FIG. 15 shows the jaws 50 of the lower walk clamp 46 open to accommodate the conductor 14 during installation and to allow the carriage 10 to walk along the conductor 14 when the corresponding jaws 50 of the upper walk clamp 42 are closed to clamp around the conductor 14.

Figure 16:
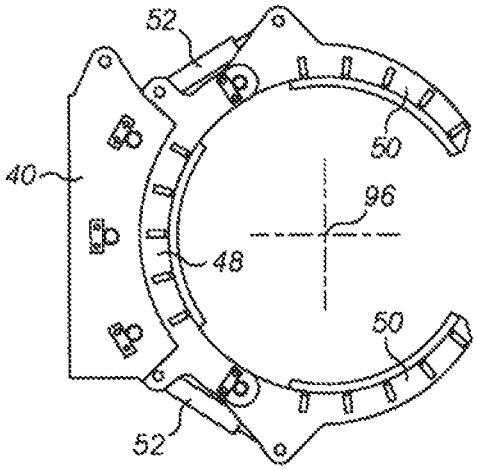

FIG. 16 shows the jaws 50 of the lower walk clamp 46 closed to clamp around the conductor 14. The clamping force must be sufficient to support the aggregate weight of the carriage assembly 16 and the payload 12 when the corresponding jaws 50 of the upper walk clamp 42 are open during walking.

Figure 17:
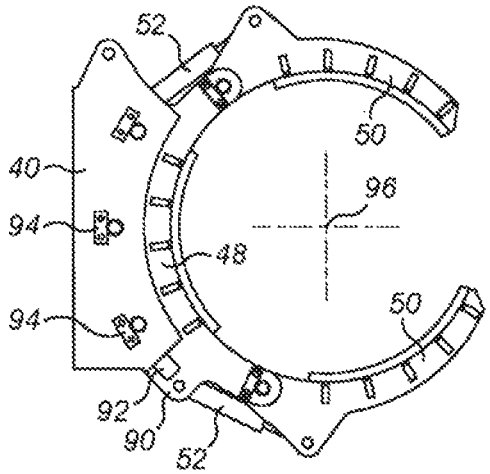

FIG. 17 exemplifies how the rotation function may be implemented. In this example, the backplate 48 comprises a rearwardly-extending flange 90 that is slidably received in a part-circumferential groove between upper and lower plates of the lower cross-member 40. The flange 90 has one or more arcuate slots 92 to receive pins 94 that extend vertically through the lower cross-member 40 and traverse the groove. These curved features have a centre of curvature on a vertical axis 96 that is disposed between the backplate 48 and the jaws 50. That axis 96 will substantially coincide with the central longitudinal axis of a conductor 14 gripped by the lower walk clamp 46 when the jaws 50 are closed in use.

The pins 94 engage within the slots 92 to hold the flange 90 in the groove in the lower cross-member 40 while enabling the flange 90 to slide along the groove. This permits angular movement of the backplate 48, and hence of the jaws 50 and the rams 52 attached to the backplate 48, relative to the lower cross-member 40.

Angular movement of the backplate 48 about the vertical axis 96 is driven by extension or retraction of one or more hydraulic rotational cylinders to apply tangential force to the backplate 48, this being an example of a rotational drive acting between the backplate 48 and the lower cross-member 40. Thus, when the jaws 50 of the lower walk clamp 46 are engaged with the conductor 14, the carriage assembly 16 and its payload 12 can be turned clockwise or anticlockwise around the conductor 14 by activating the, or each, rotational cylinder. Conversely, when the jaws 50 of the lower walk clamp 46 are disengaged from the conductor 14 so that the carriage assembly 16 and its payload 12 are supported only by the upper walk clamp 42, the lower walk clamp 46 can be turned clockwise or anticlockwise around the conductor 14.

As the upper walk clamp 42 does not have a rotation function in this example, its backplate 48 is simply fixed to the outriggers 44 that extend forwardly from the upper members 32 of the uprights 30.

Figure 18:
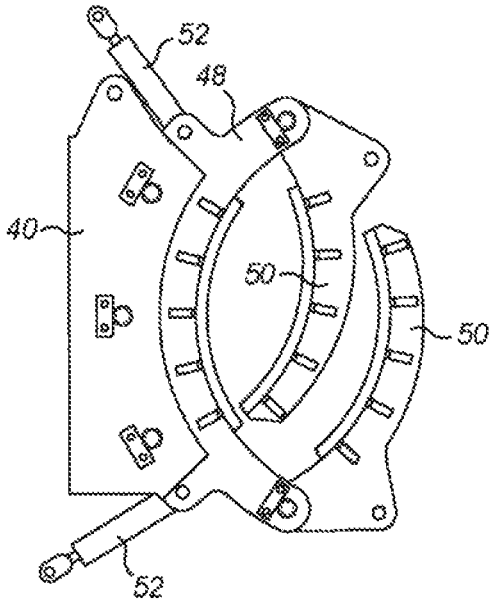
Figure 19:
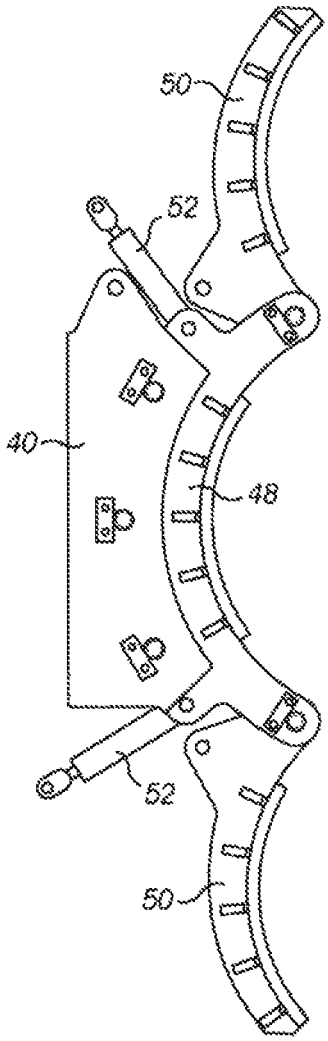

FIGS. 18 and 19 show alternative stowage, handling and deployment configuration of the lower walk clamp 46, which can beneficially reduce or modify the spatial envelope of the walk module 24. In these examples, the rods 54 of the rams 52 are temporarily disconnected from the jaws 50, if necessary, to allow the jaws 50 to swing beyond their in-use range of movement for stowing, handling and deployment. After stowing, above-deck handling or below-deck deployment of the walk module 24, the rods 54 of the rams 52 may be reconnected to the jaws 50 for use.

In this way, as shown in FIG. 18, the jaws 50 can be brought together beyond the closed position shown in FIG. 16, with one jaw 50 nested inside the other. This minimises the width of the walk module 24 and reduces its front-to-rear thickness or depth. Alternatively, as shown in FIG. 19, the jaws 50 can be swung apart beyond the open position shown in FIG. 15 so that the jaws 50 and the backplate 48 are aligned in series. Whilst this configuration increases the width of the walk module 24. It substantially decreases its front-to-rear thickness, aiding deployment to an under-deck location through a deck access hatch of a platform. Once the walk module 24 is under the deck, the rods 54 of the rams 52 may be reconnected to the jaws 50 so that the lower walk clamp 46 is ready for clamping onto a conductor 14.

FIGS. 20 to 31 will now be described. These drawings show the carriage 10 being assembled and used on a conductor 14 to deliver and install a payload in the form of a wear sleeve 12. As will be explained later, installing the wear sleeve 12 may be preceded by performing a surface treatment operation on the conductor 14 or by removing marine growth from the conductor 14. Advantageously, such operations can also employ the carriage 10 to carry suitable equipment along the conductor 14 as another payload.

FIG. 20 shows an array of vertical conductors 14 under a deck 98 of an offshore platform, represented in dashed lines. The deck 98 is above the sea surface 100, also represented in dashed lines. The conductors 14 extend above and below the sea surface 100 from the deck 98 toward the seabed. In so doing, the conductors 14 pass through a subsea conductor guide frame 102.

As will be described, the walk module 24 and the first and second payload interface modules 26, 28 of the carriage 10 are lowered below the deck 98 in turn, suitably using a crane, to assemble the carriage 10 on the conductor 14. The payload 12 is then lowered to and engaged with the assembled carriage 10. Assembly and engagement operations may be performed by rope access technicians suspended beneath the deck 98 a safe distance above the sea surface 100.

An advantage of the invention is that once the carriage 10 has been assembled and the payload 12 has been engaged with the carriage 10 during a suitable weather window, the carriage 10 can be controlled by laptop from the safety of the deck 98. Thus, the carriage 10 can transport and install the payload 12 even if weather and sea conditions deteriorate to the extent that a crane or rope access technicians cannot subsequently operate. For example, rope access technicians can work below a platform deck in wind speeds of 26 to 30 knots and in sea states with wave heights up to Hs 3.6 m. Conversely, the carriage 10 has the ability to walk the payload 12 through the splash zone in wave heights up to Hs 4.0 m while the walk clamps 42, 46 remain secure and stable on the conductor 14.

FIG. 20, and the enlarged view of FIG. 21, show the walk module 24 of the carriage 10 clamped to the conductor 14 by the lower walk clamp 46, whose jaws 50 are closed. The jaws 50 of the upper walk clamp 42 are open in this view but could also be closed as shown in FIG. 22, which shows the first and second payload interface modules 26, 28 now attached to the walk module 24 to complete the carriage 10. Next, the outboard members 60 of the rods 54 of the payload interface modules 26, 28 are driven laterally outwardly to separate the payload interface forks 70 ready to engage the payload 12.

The payload 12 is pre-prepared on the deck by latching the tooling plates 18 to respective halves 20 of the wear sleeve 12. As FIGS. 23 and 24 show, each half 20 with its associated tooling plate 18 is lowered in turn so that the tooling plates 18 engage with the respective forks 70 in turn, thus suspending the entire payload 12 from the forks 70. Interface bolts and hydraulics are now connected.

FIG. 25 shows the outboard members 60 of the rods of the payload interface modules 26, 28 retracted laterally inwardly to draw together the payload interface forks 70. This pushes the halves 20 of the wear sleeve 12 together around the conductor 14 while leaving a small predetermined gap 104 between them. This leaves a slight clearance between the wear sleeve 12 and the conductor 14 to allow the wear sleeve 12 to move along the conductor 14 over any surface irregularities such as weld seams.

Studbolts 106 (best seen in FIGS. 11 and 12) and associated nuts and washers are brought to the carriage 10. The studbolts 106 are inserted through the halves 20 of the wear sleeve 12 and the tooling plates 18. The nuts are fitted into the torque tools 82 on the tooling plates 18.

Finally, all safety installation pins are removed in preparation for use of the carriage 10. The carriage 10 is now completely controllable using a control laptop on the deck 98 of platform.

A walking operation is now ready to begin as shown in FIGS. 26 to 28, in which the carriage 10 walks down the conductor 14 by opening and closing the upper and lower walk clamps 42, 46 in a sequence involving repeated extension and retraction of the walk cylinder 36.

FIG. 26 shows the jaws 50 of the lower walk clamp 46 opened while the jaws 50 of the upper walk clamp 42 remain closed. The walk module 24 of the carriage 10 is then extended as shown in FIG. 10 by extending the walk cylinder 36 fully to push the lower walk clamp 46 down the conductor 14, away from the fixed upper walk clamp 42. Next, the jaws 50 of the lower walk clamp 46 are closed while the jaws 50 of the upper walk clamp 42 are opened as shown in FIG. 27. Then, the walk module 24 of the carriage 10 is retracted as shown in FIG. 9 by retracting the walk cylinder 36 fully to pull the upper walk clamp 42 down the conductor 14, toward the fixed lower walk clamp 46. These steps are repeated until the carriage 10 has lowered the wear sleeve 12 to the worksite, just above a guide collar 22 supported by the conductor guide frame 102.

The last few steps before approaching the worksite may not require the full stroke of the walk cylinder 36 to be used. The necessary stroke length may be calculated by using cameras and a linear transducer on the walk cylinder 36.

At the worksite as shown in FIG. 29, the walk cylinder 36 is retracted fully and the jaws 50 of the upper walk lamp 42 are closed. Next, relative angular movement between the lower walk clamp 46 and the lower cross-member 40 of the walk module 24 turns the carriage 10 and the wear sleeve 12 around the conductor 14. This aligns the gap 104 between the halves 20 of the wear sleeve 12 with a longitudinal weld seam 108 extending along the conductor 14.

Turning the carriage 10 about the conductor 14 begins by opening the jaws 50 of the lower walk clamp 46 fully while the jaws 50 of the upper walk clamp 42 remain closed. Next, the rotational drive is actuated to turn the lower walk clamp 46 by a desired angular distance relative to the lower cross-member 40, which may be calculated and judged using cameras on the carriage 10. When in position, the jaws 50 of the lower walk clamp 46 are fully closed and the jaws 50 of the upper walk clamp 42 are then fully opened. The rotational drive is retracted to the original position, which turns the entire carriage 10 and the wear sleeve 12 as required. The jaws 50 of the upper walk clamp 42 are then again fully closed.

With the wear sleeve 12 thus aligned with the weld seam 108, the halves 20 the wear sleeve 12 are brought together around the conductor 14 by being drawn in from a walk position to an insertion position using the torque tools 82 on the tooling plates 18. The positions of the halves 20 of the wear sleeve 12 are monitored using sensors. The torque tools 82 turn the nuts pre-engaged on the studbolts 106 to pull the halves 20 together. The hydraulics of the payload interface modules 26, 28 allow the forks 70 to move freely to enable this converging movement of the halves 20 of the wear sleeve 12. Using a linear transducer on the payload interface modules 26, 28, the halves 20 of the wear sleeve 12 are brought together around the conductor 14, but are not tightened.

Torqueing is currently preferred as the bolting method to draw together the halves 20 of the wear sleeve 12 because it is simple and cost-effective relative to the more complex and costly option of remote bolt tensioning. Torque tools 82 are easily installed on and removed from the nuts that engage the studbolts 106. Also, the pipework required to reverse a torque tool 82 is relatively simple. Reversible torque tools 82 allow nuts to be run up and down the studbolts 106, which helps to ensure that the carriage 10 can be recovered in the event of problems during installation.

Next, the jaws 50 of the lower clamp are opened as shown in FIG. 30 and the walk to module 24 is again extended as shown in FIG. 10 by extending the walk cylinder 36 a set distance, which may be judged using cameras and a linear transducer on the walk cylinder 36. This pushes the lower members 34 of the uprights 30 and the attached payload interface modules 26, 28, including the forks 70, downwardly. The downward movement of the forks 70 acting via the tooling plates 18 presses the wear sleeve 12 into the guide collar 22, thus interposing the wear sleeve 12 between the conductor 14 and the guide collar 22. The wear sleeve 12 should not be pushed so far that its clamping section contacts the guide collar 22.

Once the wear sleeve 12 has been inserted in this way, a final bolt-torqueing operation is performed to torque the studbolts 106 to a pre-determined tension using the torque tools 82 on the tooling plates 18. The tooling plates 18 are then unlatched from the halves 20 of the wear sleeve 12, allowing the forks 70 to be separated to disengage the tooling plates 18 from the wear sleeve 12. This leaves behind no installation tooling subsea, producing the same result as a diver installation.

Once the tooling plates 18 are clear of the studbolts 106, the walk cylinder 36 is retracted to lift the tooling plates 18 completely clear of the wear sleeve 12. The carriage 10 is then free to walk back up the conductor 14 for further operations. In this respect, FIG. 31 shows the assembly 16 of the carriage 10 and the tooling plates 18 disengaged from the now-installed wear sleeve 12 and starting to walk back up the conductor 14. The payload interface cylinder 56 has been retracted to bring the tooling plates 18 closer together to reduce the possibility of snagging and to increase stability during the ascent up the conductor 14.

On reaching an above-surface 100, under-deck 98 level of the conductor 14, the carriage 10 can be disassembled for recovery and demobilisation or, if required, moved to another conductor 14 to repeat the operation. After disconnecting their hydraulic supply, the tooling plates 18 are removed from the carriage 10 and recovered onto the deck 98 of the platform to be stowed or to be latched to a further pair of halves 20 of a wear sleeve 12 if required for a repeated operation. The various modules 24, 26, 28 of the carriage 10 are removed and recovered to the deck 98 of the platform through an access hatch, or by cross-hauling, following the reverse of the abovementioned procedure used to install the carriage 10 onto the conductor 14.

Retaining pins should be incorporated to ensure that when modules 24, 26, 28 are lifted during deployment and recovery, their moving parts are locked by mechanical engagement and not by relying solely upon hydraulics. These pins may be removed on deployment and reinstated on recovery by rope access technicians. Additionally, a tether should be used to ensure that the carriage 10 cannot be dropped.

It will be apparent that the invention provides a modular tool that can install existing wear sleeves 12 with minimal modifications while meeting other project requirements. The modules 24, 26, 28 could be incorporated into other installation tools. Conversely, it is possible to deploy alternative payloads on the same carriage 10. Thus, the carriage 10 is capable of accommodating various alternative payloads other than a wear sleeve 12. One such alternative payload is surface preparation tooling; another is a package to remove marine growth. The design of the payload interface, including the forks 70, aids engagement of payloads with the carriage 10 and enables such payloads to be interchanged easily while the carriage 10 is clamped onto a conductor 14.

Thus, the payload interface allows a range of payloads to be deployed using the same mechanical interface and for the carriage 10 to undock from the payload remotely if required. Further examples of payloads include: bolt torqueing equipment; bolt tensioning equipment; cutting tools; water-jetting equipment; cleaning and cutting equipment; mechanical cleaning equipment; clamps, including grouted clamps; sleeves; cameras; lights; sensors; metrology tools; measurement tools; laser tools; anodes; and structural components.

Surface treatment may, for example, be performed by a grit-blasting spread comprising a hinged guide ring attached to an interface of the tool. The payload interface forks 70 need not open fully. A grit blasting nozzle and an optional jetting nozzle to remove marine growth may be attached to a linear tool that moves the nozzles up and down the conductor 14. This linear tool may be fitted to the guide ring so that the nozzle can move 360° around the conductor 14.

A grit-blasting spread may be lowered through a deck access hatch and engaged with the payload interface forks 70 of the carriage 10 pre-installed on the conductor 14. Once the interface is attached, the guide ring is closed and bolted together. When a downline bringing power to the grit-blasting spread has been lowered and fitted, the spread is ready to be transported to the worksite by walking the carriage 10 down the conductor 14. A benefit of this approach is that it allows other regions of the conductor 14 to be cleaned in transit if required.

Other variants are possible within the inventive concept. In one such variant, the forks 70 could remain static during installation of a payload, leaving the equivalent opening/closing function to be managed by jacks, studbolts or another closing mechanism integrated with that payload. For example, studbolts or jacks could extend between the two halves 20 of the wear sleeve 12 while an opening mechanism is disposed between a tubular sleeve 72 and an interface plate 76. This has the advantage that the configuration of FIG. 12 can be achieved at the outset as the studbolts are pre-inserted.

The invention claimed is:

1. A method of walking a remotely-operated subsea carriage along an elongate member of an offshore structure that contains a longitudinal axis, the carriage comprising leading and trailing clamps connected to one another via an axially-extensible frame, wherein at least one of the clamps is attached to the axially-extensible frame via a rotationally-displaceable coupling that is circumferentially movable about the longitudinal axis relative to the frame, the method comprising:

opening and closing the leading and trailing clamps of the carriage to release and grip the elongate member in a sequence that includes moving the leading clamp forward when the leading clamp is open and moving the trailing clamp forward when the leading clamp is closed; and when either of the clamps is open, driving relative angular movement between the clamps around the longitudinal axis of the elongate member, wherein driving angular movement between the clamps around the longitudinal axis is effected by driving movement of the coupling, and thereby movement of the associated clamp, circumferentially about the longitudinal axis, by actuating a rotational drive.

2. The method of claim 1, comprising turning the carriage around the elongate member by driving relative angular movement between a clamp and the carriage when that clamp is closed and the other clamp is open.

3. The method of claim 1, comprising driving relative angular movement between a clamp and the carriage when that clamp is open and the other clamp is closed.

4. The method of claim 3, comprising driving relative angular movement between the open clamp and the carriage before, during or after moving that clamp forward while open.

5. The method of claim 1, comprising attaching the carriage to the elongate member at an above-surface location and then walking the carriage along the elongate member to a subsea location.

6. The method of claim 1, comprising assembling the carriage on the elongate member and then walking the assembled carriage along the elongate member.

7. The method of claim 5, preceded by lowering the carriage in a collapsed or disassembled form to the elongate member from a deck level above the elongate member.

8. The method of claim 1, comprising engaging a payload with the carriage after attaching the carriage to the elongate member.

9. The method of claim 1, comprising engaging a payload with the carriage by moving the payload relative to a payload support of the carriage in a direction transverse to the walking direction.

10. The method of claim 1, comprising disengaging a payload from the carriage by moving a payload support of the carriage relative to the payload in a direction transverse to the walking direction.

11. The method of claim 1, comprising moving a payload support of the carriage in a direction transverse to the walking direction while attached to the payload.

12. The method of claim 11, comprising moving a pair of payload supports in opposite directions transverse to the walking direction, to separate or to bring together portions of the payload.

13. The method of claim 12, comprising bringing portions of the payload together around the elongate member.

14. The method of claim 1, wherein the rotationally-displaceable coupling comprises at least one arcuate slot providing a path curved about the longitudinal axis, and at least one pin engaging with and being movable relative to the at least one slot, and wherein driving movement of the coupling circumferentially about the longitudinal axis comprises actuating the rotational drive to drive relative movement of the at least one pin along the curved path provided by the at least one slot.

15. A method of installing a wear sleeve at a subsea worksite using a remotely-operated subsea carriage, the subsea carriage comprising leading and trailing clamps connected to one another via an axially-extensible frame, a walk drive acting on the frame and operable to extend and retract the frame in a direction parallel to the longitudinal axis to vary an axial distance between the clamps, and a payload interface attached to the frame and with which the wear sleeve is removably engaged, the method comprising:

carrying the wear sleeve to the worksite by walking the remotely-operated subsea carriage along an elongate member of an offshore structure, opening and closing the leading and trailing clamps of the carriage to release and grip the elongate member in a sequence that includes moving the leading clamp forward when the leading clamp is open and moving the trailing clamp forward when the leading clamp is closed; and at the worksite, applying installation force to the wear sleeve in a forward direction by actuating the walk drive to extend the axially-extensible frame in the forward direction, and thereby move the leading clamp forward when the leading clamp is open and the trailing clamp is closed, and move the payload interface in the forward direction, so as to insert the wear sleeve between a conductor and a surrounding guide collar.

16. The method of claim 15, wherein at least one of the clamps is attached to the frame via a rotationally-displaceable coupling that is circumferentially movable about the longitudinal axis relative to the frame, the method comprising, before applying the installation force to the wear sleeve, driving relative movement between the coupling and its associated clamp, and the frame, about the longitudinal axis, thereby turning the wear sleeve around the elongate member while carrying the wear sleeve to the worksite or at the worksite.

17. The method of claim 15, comprising attaching the carriage to the elongate member at an above-surface location and then walking the carriage along the elongate member to a subsea location.

18. The method of claim 15, comprising assembling the carriage on the elongate member and then walking the assembled carriage along the elongate member.

19. The method of claim 18, preceded by lowering the carriage in a collapsed or disassembled form to the elongate member from a deck level above the elongate member.

20. The method of claim 15, comprising engaging a payload the wear sleeve with the carriage after attaching the carriage to the elongate member.

21. The method of claim 15, comprising engaging the wear sleeve with the carriage by moving the wear sleeve relative to a payload support of the carriage in a direction transverse to the walking direction.

22. The method of claim 15, comprising disengaging the wear sleeve from the carriage by moving a payload support of the carriage relative to the wear sleeve in a direction transverse to the walking direction.

23. The method of claim 15, comprising moving a payload support of the carriage in a direction transverse to the walking direction while attached to the wear sleeve.

24. The method of claim 23, comprising moving a pair of payload supports in opposite directions transverse to the walking direction, to separate or to bring together portions of the wear sleeve.

25. The method of claim 24, comprising bringing portions of the wear sleeve together around the elongate member.

* * * * *